US005728966A

United States Patent [19]

Bobinger et al.

[11] Patent Number: 5,728,966

[45] Date of Patent: Mar. 17, 1998

[54] LIFTING DEVICE IN AN ARMOURED VEHICLE

[75] Inventors: Rudolf Bobinger, Nordendorf; Andreas Riegl, Wertingen; Wilhelm Strasser, Obermeitingen, all of Germany

[73] Assignee: KUKA Wehrtechnik GmbH, Augsburg, Germany

[21] Appl. No.: 590,906

[22] Filed: Jan. 24, 1996

[30] Foreign Application Priority Data

May 6, 1995 [DE] Germany ..... 195 16 706.6

[51] Int. Cl.[6] ..... F41A 9/42

[52] U.S. Cl. ..... 89/46; 89/47

[58] Field of Search ..... 89/45–47, 33.05

[56] References Cited

U.S. PATENT DOCUMENTS

| | | | |
|---|---|---|---|
| 366,348 | 7/1887 | Seabury | 89/46 |
| 3,197,251 | 7/1965 | Travis | 294/104 |
| 3,242,814 | 3/1966 | Carlsson | 89/46 |
| 4,236,441 | 12/1980 | Turner et al. | 89/40 F |
| 4,635,875 | 1/1987 | Apple | 254/294 |
| 4,904,142 | 2/1990 | Sato | 414/142.6 |

FOREIGN PATENT DOCUMENTS

| | | | |
|---|---|---|---|
| 627541 | 5/1963 | Belgium | 89/45 |
| 503317 | 6/1920 | France | 89/46 |
| 862443 | 3/1941 | France | 89/45 |
| 2 588 371 | 4/1987 | France . | |
| 1 578 093 | 5/1971 | Germany . | |
| 37 25 762 | 2/1989 | Germany . | |
| 7083 | 3/1898 | United Kingdom | 89/46 |

*Primary Examiner*—Stephen M. Johnson

*Attorney, Agent, or Firm*—Antonelli, Terry, Stout & Kraus, LLP

[57] ABSTRACT

The invention relates to a lifting device in an armoured vehicle. The lifting device comprises a holder, which can be engaged with a body to be raised, particularly a shell. A driven lifting element is also provided, by means of which the holder can be raised and lowered. In order to be able to take up and transfer in simple, flexible manner the shells, the lifting element is a cable drivable by means of a winch, which is guided on a pivotable, multicomponent articulated arm and carries the holder at its lower end. Preferably the cable passes through the articulated arm and its free end extends substantially vertically downwards, the articulated arm being pivotable substantially in a horizontal plane.

14 Claims, 4 Drawing Sheets

LIFTING DEVICE IN AN ARMOURED VEHICLE

FIELD OF THE INVENTION

The invention relates to a lifting device in an armoured vehicle, having a holder which is engageable with a body to be raised and in particular a shell, and a driven lifting element, by means of which the holder can be raised and lowered.

BACKGROUND OF THE INVENTION

In tanks or armoured vehicles it is conventional practice for obtaining a maximum battle strength, to carry a large amount of ammunition or shells in a magazine. A shell can be supplied to the weapon from the magazine either manually or using so-called loading aids. As shells are relatively heavy, the manual lifting and transferring of shells is not only very strenuous, but in the long term is not very effective.

A loading aid in the form of a substantially vertically pivotable loading arm is known, which carries a holder, which is able to receive the shells. The loading arm can be raised and lowered either by means of a hydraulic cylinder or due to gravity in combination with a restoring spring, so that the shell can be supplied from the magazine to a rammer of the weapon. For reception by the loading arm the shell must assume a predetermined position in the magazine, which leads to a rearrangement of the shells in the magazine and therefore to a constructionally complicated magazine structure, which involves high costs. In addition, the loading arm is not usable for random raising and lowering of shells within the armoured vehicle and is consequently not flexibly usable.

The problem of the invention is to provide a lifting device in an armoured vehicle with which it is possible to receive and transfer in a simple and flexible manner more especially shells.

SUMMARY OF THE INVENTION

According to the invention this problem is solved in that the lifting element is a cable drivable by means of a winch and which is guided on a pivotable, multicomponent articulated arm and carries at its lower end the holder.

By means of the pivotable, multicomponent articulated arm it is possible to cover a large area of the interior of the armoured vehicle, so that each shell located within the pivoting area of the articulated arm can be taken up in simple manner with the lifting device according to the invention. As the lifting element is a cable, the user can bring about minor position corrections by a transverse deflection of the cable, without having to adjust the articulated arm.

Preferably the articulated arm is mounted in freely projecting manner and comprises a first arm component fitted in articulated manner by its one end to the armoured vehicle and a second arm component fitted in articulated manner to the other end of the first arm component. A two-component construction of the articulated arm has proved advantageous for bringing the articulated arm in a rapid and reliable manner to a desired position.

According to a preferred development of the invention the articulated arm is substantially pivotable in a horizontal plane. In order to raise a shell from the bottom of the interior of the armoured vehicle, the articulated arm is pivoted in the horizontal plane into a position in which the cable is located substantially above the shell. The cable preferably passes through the articulated arm and extends substantially vertically downwards at its free end. Thus, the vertical movement of the shell is solely determined by the cable and the horizontal movement of the shell by the articulated arm. This permits simple handling, because the user can perform the two movement components independently of one another and superimpose them in a random manner.

Preferably the articulated arm is fitted in the roof area of the armoured vehicle, which leads to a relatively long, vertical extension length of the cable. Through the transverse deflection of the cable this once again enables a user to reach remote areas of the interior of the armoured vehicle with the holder fitted to the cable.

In a special development of the invention the winch is formed by a per se known servowinch. The servowinch permits an electrical weight balance enabling the user of the lifting device to take up, move and deposit in a desired position the shell whilst involving relatively little force expenditure.

The holder for receiving the shells can be constituted by any random mechanism, which permits a rapid reception or taking up of the shells and ensures the secure holding thereof. Preferably the holder has a receptacle into which can be inserted the shells to be raised and which has a locking element by means of which the shells can either be fixed in random manner in or released from the receptacle. The locking element can be a displaceably mounted, spring-loaded locking bolt. Such a shell gripper is known from the applicant's patent application P 44 42 313.6, to whose content express reference is made.

When using a lifting device according to the invention the user will grip the holder by a handle optionally fixed thereto. It has proved advantageous if the holder also carries a control device for the winch movement control, so that the user can control the shell raising and lowering from the holder or even its handle. Advantageously the control device has an infrared transmitter fitted to the holder and said transmitter cooperates with a corresponding infrared receiver of the winch.

If the electric drive of the lifting device and therefore the cable winch fails, the operator located in the armoured vehicle would have to manually transfer the shells. In order to facilitate this, in a further development of the invention, the holder is detachably coupled to the cable. In the case of an electrical fault the holder can be removed manually from the cable and handled in emergency operation. The operator can also engage the holder with a shell and handle or take up the same by means of the handle fitted to the holder. In manual operation it is appropriate and helpful due to the relatively high weight of a shell, if two operators can grip the shell. For this purpose the holder can have a further handle for the second operator.

So that the further handle has no hindering action in the normal operation of the lifting device and so as not to take up excessive construction space, according to a further development of the invention the further handle can be extended or swung out from a position flush in the holder.

The lifting device cannot only be used for removing a shell from the magazine and for depositing it in a rammer, but instead by means of the lifting device the shells can also be placed in the magazine. For this purpose the shells must be conveyed from the outside of the armoured vehicle into its interior, so that they can be taken up by the lifting device and placed in the magazine. In order to be able to convey the relatively heavy shells in simple manner into the armoured vehicle, the invention provides a conveying mechanism by means of which the shells can be brought from the outside of the vehicle into the pivoting area of the articulated arm. The shell is placed on the conveying mechanism by an operator on the outside of the armoured vehicle and can then be moved into the interior of said vehicle.

Normally an armoured vehicle has on its back a rear entrance hatch, which can be closed by a hatch door and through which personnel and/or material can pass into the interior of the armoured vehicle. According to a particularly advantageous development of the invention, the conveying mechanism has a driven slide displaceably mounted on the entrance hatch. After the shell has been deposited on the slide, the latter is moved into the interior, so that the lifting device can directly remove the shell from the slide.

So that the entrance hatch is impeded to the minimum extent by the conveying mechanism, the slide together with its guide can be fitted in pivotable manner to the entrance hatch door and can be brought into an inoperative position substantially freeing the said hatch. Thus, if the conveying mechanism is not required, it is pivoted into the inoperative position, where it is as close as possible to the inside of the door, so that the effective cross-section of the entrance hatch is only insignificantly reduced. When the conveying mechanism is in use it is folded down into its operating position.

The lifting device is so positioned and designed that the articulated arm covers all the essential areas of the interior of the armoured vehicle. Thus, a shell or a round can be taken up from the slide used for loading the armoured vehicle, from the magazine, from any point in the vehicle bottom area and from the conventionally present turret magazine. The shell taken up by the holder can be deposited at any of the indicated locations and preferably in the rammer or directly in the weapon.

BRIEF DESCRIPTION OF THE DRAWINGS

Further details and features of the invention can be gathered from the following description of an embodiment with reference to the drawings, wherein show.

DETAILED DESCRIPTION OF THE DRAWINGS

Figure 1:
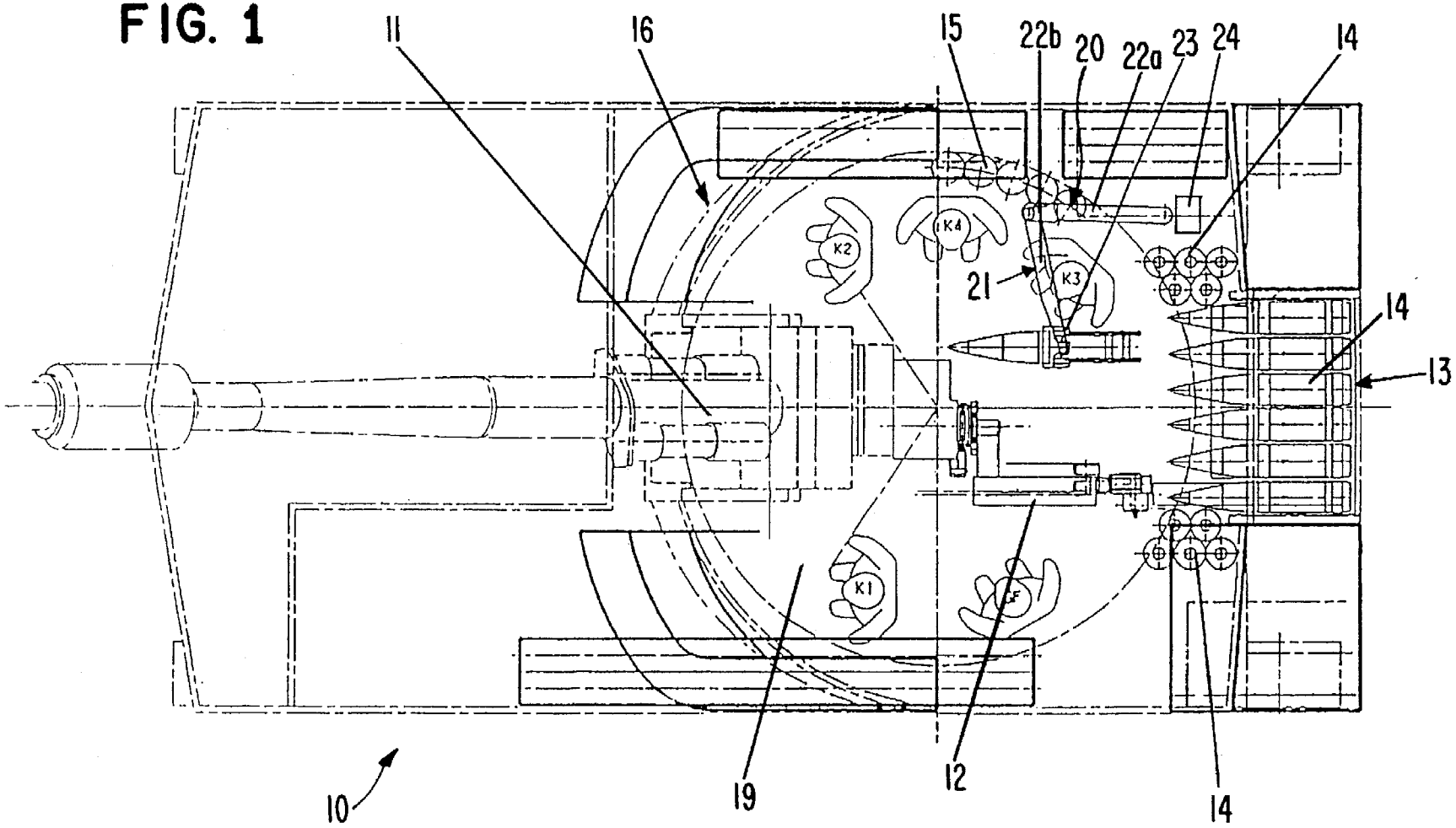
FIG. 1 A diagrammatic, part sectionally represented plan view of an armoured vehicle.
Figure 2:
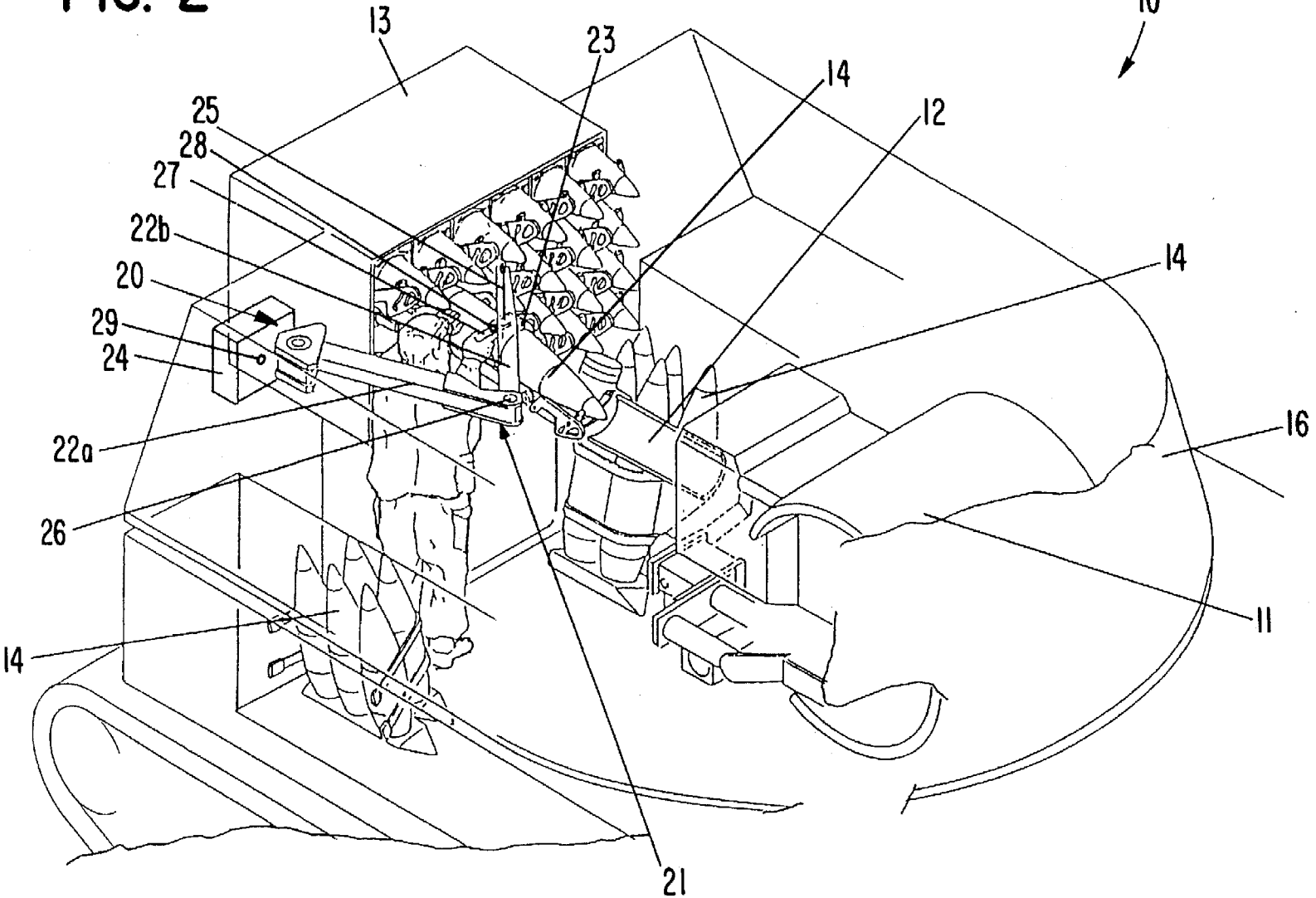
FIG. 2 The interior of the armoured vehicle in a perspective view.

FIGS. 1 and 2 show an armoured vehicle 10 which, in conventional manner, has a weapon 11 located on a rotary turret 16. In the interior 19 of the turret 16 are stored a plurality of shells 14, which are either received in a magazine 13 in a substantially horizontal orientation at the rear end of the armoured vehicle 10 or are stored in the interior in a substantially vertical orientation. The interior also contains several prepared propellant charges 15. To load the weapon 11, a shell 14 must be inserted in a rammer 12, with the aid of which the shell can be supplied to the weapon 11.

To be able to transfer the shells 14 into the interior of the armoured vehicle 10, a lifting device 20 is provided. The lifting device 20 comprises a two-component articulated arm 21 with a first arm component **22*a*, whose one end is fitted in articulated manner to the roof of the interior of the armoured vehicle. A second arm component 22*b* is connected in articulated manner to the other end of the first arm component 22*a*. The two arm components 22*a*, 22*b*** are located substantially in a horizontal plane and are pivotable therein.

With the articulated arm 21 is associated a servowinch 24, from which a cable 25 extends through the articulated arm 21 up to the front end of the second arm component **22*b* and from there passes substantially vertically downwards. At the lower end of the cable 25 is positioned a holder 23 with a handle 27. The holder 23 has a receptacle into which can be inserted the shell 14 to be transferred, as well as a locking element with which the shell can be fixed in the receptacle. On the holder is located a control device for controlling the functions or movements of the servowinch 24. The control device comprises an infrared transmitter 28 fitted to the holder and which cooperates with a corresponding infrared receiver 29 on the servowinch 24**.

According to FIG. 2 the magazine 13 is constructed as a drawer magazine, the individual shells 14 being placed on an extendable drawer. In order to transfer a shell 14 from the magazine 13 into the rammer 12 for the weapon 11, the desired shell 14 is extracted from the magazine 13 and the articulated arm 21 is so pivoted and positioned by the user that the free end of the second arm component **22*b* is positioned somewhat above the shell 14 to be received. By operating the servowinch 24 the holder 23 is then lowered until it is placed round the shell 14 and can take up the latter. By operating the winch 24, accompanied by the simultaneous pivoting of the articulated arm 21, the shell 14 can be removed from the drawer of the magazine 13 and placed in the rammer 12**.

Figure 3:
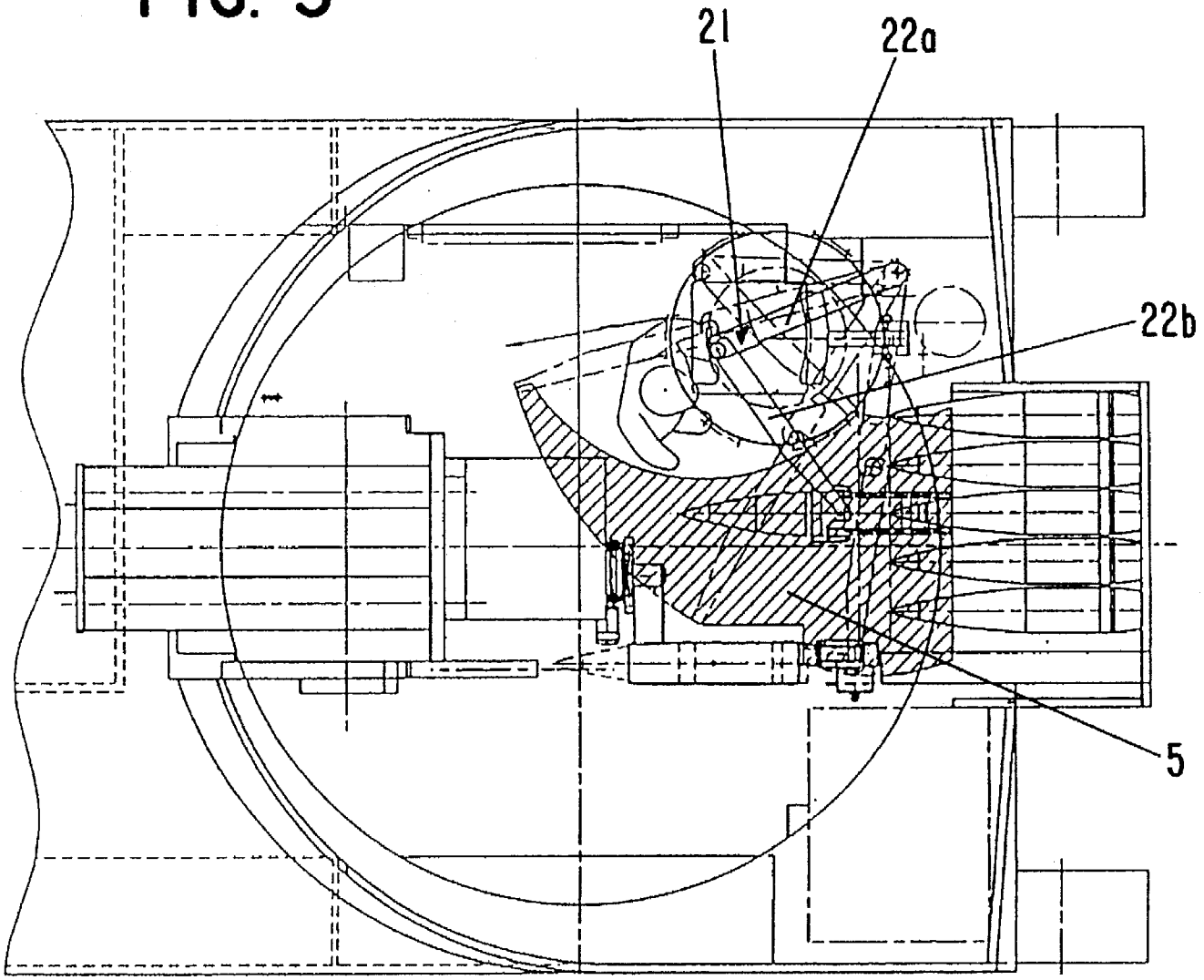
FIG. 3 A detail plan view of the interior of the armoured vehicle.

For clearly illustrating the pivoting area S in FIG. 3, hatching is used for the area which can be covered by the outer, free end of the second arm component **22*b* of the articulated arm 21**. However, as the cable can be deflected by the user in the transverse direction of its longitudinal extension with limited force expenditure, the area of the interior of the armoured vehicle covered by this lifting device is further increased compared with the pivoting area S, so that virtually the entire interior can be reached.

Figure 5:
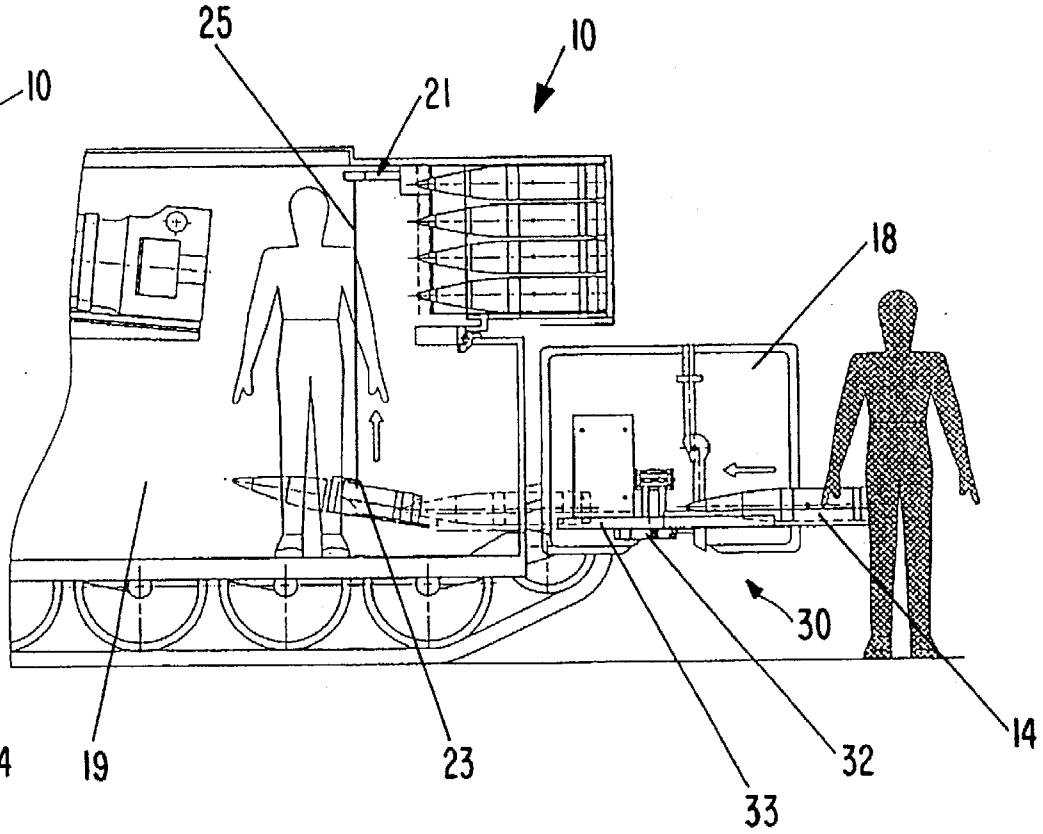
FIG. 5 A cross-section through the rear part of an armoured vehicle.
Figure 4:
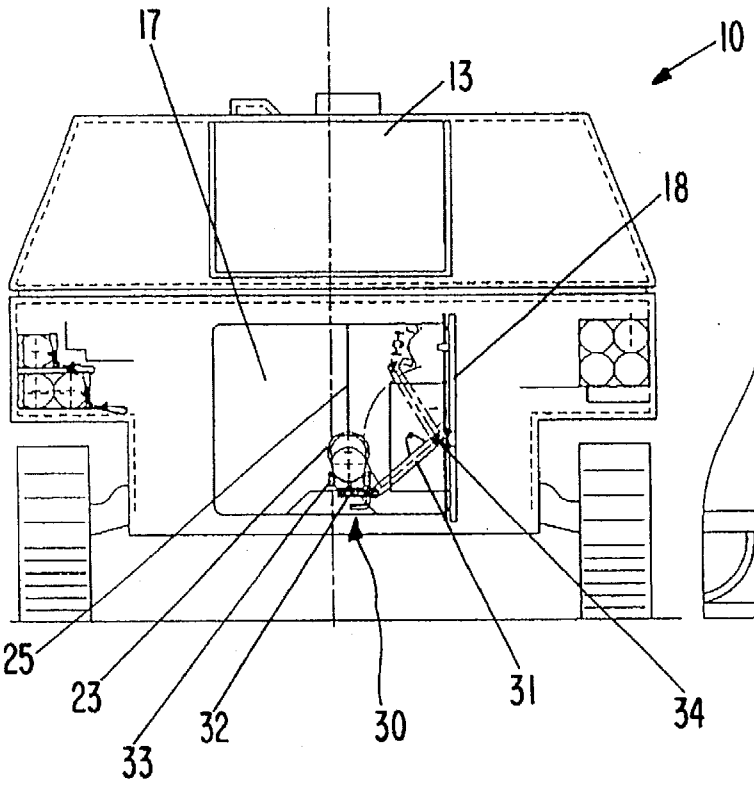
FIG. 4 A rear view of the armoured vehicle.

Apart from the transfer of the shells from the magazine 13 into the rammer 12, the lifting device 20 can also be used for filling the magazine 13. Use is in particular made of a conveying mechanism 30, as shown in FIGS. 4 and 5.

On its back the armoured vehicle 10 has an entrance hatch 17, which can be closed by a door 18. On the door 18 a holding arm 31 is vertically pivotably mounted by means of an articulation 34. At the free end of the holding arm 31 is constructed a guideway 32 on which a slide 33 is displaceably guided.

For loading the magazine 13 with shells 14, a shell 14 is placed by an operator located on the outside of the armoured vehicle 10 on the slide 33 and then the latter is moved along the guideway 32 through the entrance hatch 17 into the armoured vehicle interior 19, which can take place either manually or by means of a corresponding drive mechanism. The shell 14 located on the slide 33 is then gripped by the operator located in the vehicle interior 19 with the aid of the lifting device, in that the holder 23 is fixed to the shell 14. By raising the shell by means of the activation of the winch and by pivoting the articulated arm 21, the shell can be taken up from the slide 33 and deposited in a desired drawer of the magazine 13.

The pivotable mounting of the holding arm 31 on the door 18 makes it possible to pivot the complete conveying mechanism 30 into an inoperative position, where it is as close as possible to the door 18, so that the entrance hatch is substantially free and the entrance and exit is not impeded by the conveying mechanism 30. The inoperative position of the conveying mechanism 30 is shown in broken line form in FIG. 4.

We claim:

1. Lifting device in an interior of an armoured vehicle, which comprises a holder which is engageable with a body to he moved and a driven lifting element by means of which the holder can he moved, the lifting element comprising a cable which is drivable by a winch, which is guided on a pivotable, multicomponent articulated arm and which is secured at a lower end to the holder; the multicomponent articulated arm being mounted in a freely projecting manner in a roof area of the interior of the armoured vehicle and being pivotable substantial in a horizontal plane relative to the interior of the armoured vehicle and the holder being raised and lowered by the cable.

2. Lifting device according to claim 1, wherein the body is a shell to be supplied to a weapon.

3. Lifting device according to claim 2, wherein the holder has a receptacle into which can be introduced the shell to be raised, as well as a locking element, by means of which the shell can either be fixed in or released from the receptacle.

4. Lifting device according to claim 2, wherein a conveying mechanism by means of which the shell can be brought from the the outside of the armoured vehicle into a pivoting area S of the articulated arm.

5. Lifting device according to claim 4, in which the armoured vehicle has a rear entrance hatch of a closure arrangement, wherein the conveying mechanism has a driven slide displaceably mounted on a wall of the closure arrangement.

6. Lifting device according to claim 5, wherein the slide, together with a guideway, is pivotably fitted to a door of the entrance hatch of the closure arrangement and can be brought into an inoperative position substantially freeing passage through the entrance hatch.

7. Lifting device according to claim 6, wherein a movement field of the articulated arm is such that shells can be taken up from the slide, a magazine, from a bottom of the armoured vehicle and from a turret magazine, as well as to a rammer or the weapon.

8. Lifting device according to claim 1, wherein the articulated arm has a first arm component fitted in an articulated manner by one end to an interior wall of the armoured vehicle and a second arm component fitted in an articulated manner to the other end of the first arm component.

9. Lifting device according to claim 1, wherein the cable passes through the articulated arm and has a free end that extends substantially vertically downwards.

10. Lifting device according to claim 1, wherein the winch is a servowinch.

11. Lifting device according to claim 1, wherein a control device for the movement control of the winch is constructed on the holder.

12. Lifting device according to claim 1, wherein the control device has an infrared transmitter, which cooperates with a corresponding infrared receiver of the winch.

13. Lifting device according to claim 1, wherein the holder is detachably coupled to the cable.

14. Lifting device according to claim 1, wherein the holder has a handle.

* * * * *